US010759560B2

(12) United States Patent
Kang

(10) Patent No.: US 10,759,560 B2
(45) Date of Patent: Sep. 1, 2020

(54) TRAY FOR GELATIN-BASED FOOD PRODUCT

(71) Applicant: Jason Kang, Beverly Hills, CA (US)

(72) Inventor: Jason Kang, Beverly Hills, CA (US)

( * ) Notice: Subject to any disclaimer, the term of this patent is extended or adjusted under 35 U.S.C. 154(b) by 79 days.

(21) Appl. No.: 15/940,598

(22) Filed: Mar. 29, 2018

(65) Prior Publication Data

US 2019/0300226 A1 Oct. 3, 2019

(51) Int. Cl.

| | |
|---|---|
| ***B65D 1/36*** | (2006.01) |
| ***B65D 6/06*** | (2006.01) |
| ***B65D 85/72*** | (2006.01) |
| ***B65D 83/04*** | (2006.01) |
| ***B65D 50/04*** | (2006.01) |
| ***A61J 1/03*** | (2006.01) |

(52) U.S. Cl.

CPC ..... *B65D 1/36* (2013.01); *B65D 11/12* (2013.01); *B65D 50/043* (2013.01); *B65D 83/04* (2013.01); *B65D 85/72* (2013.01); *A61J 1/03* (2013.01); *B65D 2215/02* (2013.01)

(58) Field of Classification Search

CPC ..... B65D 11/12; B65D 50/043; B65D 25/10; B65D 1/36; B65D 83/72; B65D 2215/02; A61J 1/03

USPC ..... 206/804, 712, 557–567, 445; 220/559

See application file for complete search history.

(56) References Cited

U.S. PATENT DOCUMENTS

| | | | | | |
|---|---|---|---|---|---|
| 2,367,019 | A * | 1/1945 | Haag | B65D 83/0445 | 206/539 |
| 3,164,478 | A * | 1/1965 | Bostrom | B65D 85/36 | 426/119 |
| 3,362,530 | A * | 1/1968 | Johnson | B65D 83/04 | 206/535 |
| 3,439,827 | A * | 4/1969 | Marland | B65D 83/005 | 215/12.1 |
| 3,791,514 | A * | 2/1974 | Watanabe | B65D 11/12 | 204/407 |
| 4,541,528 | A * | 9/1985 | Holmes | B65D 85/58 | 206/0.82 |
| 4,715,492 | A * | 12/1987 | Holmes | G07D 9/004 | 206/0.83 |
| 5,337,915 | A * | 8/1994 | Hall, Jr. | B65D 25/16 | 206/804 |
| 5,608,940 | A * | 3/1997 | Panyon, Jr. | A46B 11/001 | 132/311 |
| 5,620,109 | A * | 4/1997 | Madden | B65D 11/12 | 206/536 |
| D542,316 | S * | 5/2007 | Jackson | D9/733 | |
| 7,487,878 | B2 * | 2/2009 | Giwargis | B65D 83/005 | 220/23.83 |

(Continued)

*Primary Examiner* — Chun Hoi Cheung

(74) *Attorney, Agent, or Firm* — Edmond A. DeFrank

(57) ABSTRACT

The embodiments disclose a tray method and devices including a method including creating a half-cylindrical tray with anti-slide features on an interior surface and a flexible pull tab at one end of the half-cylindrical tray, forming a child proof bottle with child proof bottle security tabs wherein the tray can be inserted, forming a child proof cap with child proof cap security tabs corresponding to the child proof bottle security tabs for securing the child proof cap to the child proof bottle, and wherein storing gelatin edible wafers in the tray includes gelatin edible candies and gelatin wafer products with infused medicinal ingredients.

13 Claims, 6 Drawing Sheets

(56) References Cited

U.S. PATENT DOCUMENTS

| | | | | |
|---|---|---|---|---|
| 8,333,281 | B2 * | 12/2012 | Saltsov | A61J 1/03 206/1.5 |
| 8,523,013 | B2 * | 9/2013 | Sines | B65D 21/08 221/135 |
| 2005/0242055 | A1 * | 11/2005 | Oh | B65D 41/0471 215/332 |
| 2011/0024420 | A1 * | 2/2011 | King | B65D 51/18 220/254.8 |
| 2012/0325816 | A1 * | 12/2012 | Buono | B65D 41/06 220/315 |

* cited by examiner

TRAY FOR GELATIN-BASED FOOD PRODUCT

BACKGROUND

Soft gelatin-based candies, such as a soft viscid gel-like candy, sometimes referred to as a gummy edible candy, are food products that have become very popular. One inconvenience is typically the soft gel-like products are packaged in bag packages including bags that are not reclosable and do not prevent the soft gel-like products from spilling out of the bag and sticking to each other. Further, the bags are bulky and difficult to carry on one's person.

DETAILED DESCRIPTION OF THE INVENTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the embodiments.

General Overview:

It should be noted that the descriptions that follow, for example, in terms of tray for soft gelatin edibles is described for illustrative purposes and the underlying system can apply to any number and multiple types of soft gelatin edible products. In one embodiment, the soft gelatin tray for edibles can be used to store medical and legalized cannabis edible products and the like. In another embodiment of the present invention, the tray for soft gelatin edibles can be configured using flexible plastic materials. The tray for soft gelatin edibles can be configured to include anti-slide bumps and can be configured to include anti-slide rings using the embodiments.

Figure 1:
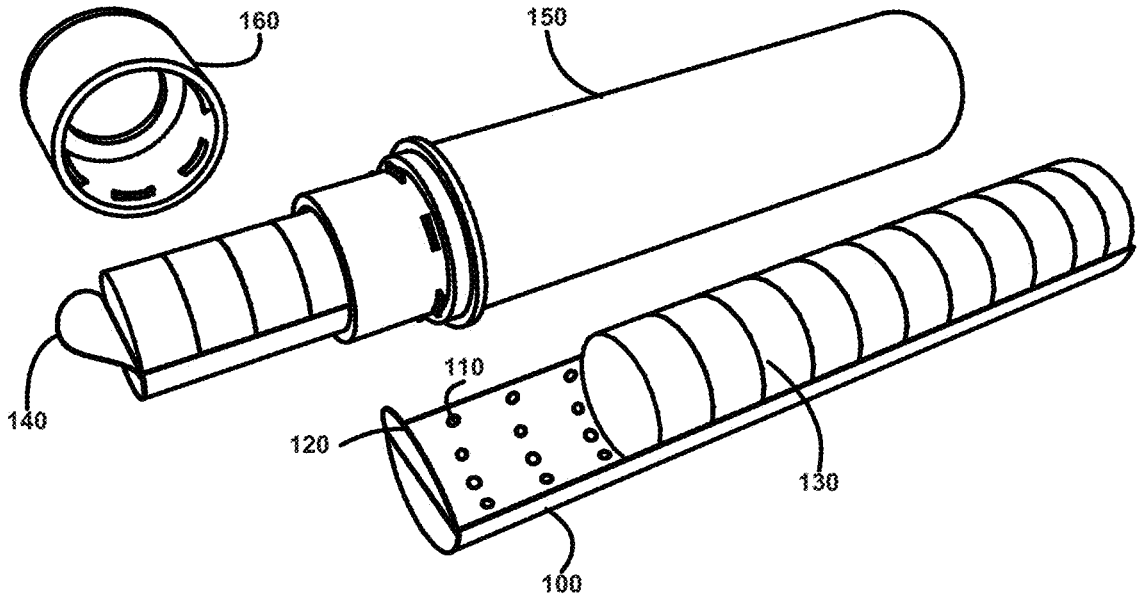
FIG. 1 shows an overview drawing of the tray for soft gelatin edibles of one embodiment.

FIG. 1 shows a block diagram of an overview of the tray for soft gelatin edibles of one embodiment. FIG. 1 shows a tray for soft gelatin edibles 100 for holding soft gelatin edible products for human consumption. The tray for soft gelatin edibles 100 can include anti-slide bump 110 features on the interior surface to prevent the soft gelatin edible products from sliding out of the tray unintentionally. The tray for soft gelatin edibles 100 includes a pull tab 120 that is flexible and is oriented to an angle off of vertical and angled away from the body of the tray for soft gelatin edibles 100. The angled orientation permits a user to use a finger to reach the top edge and bend the flexible pull tab 120 outward to pull the tray for soft gelatin edibles 100 out of a child proof bottle 150 with a child proof cap 160 removed. The user in flexing the pull tab 140 outward can using two fingers or one finger and a thumb to extract the tray for soft gelatin edibles 100 a distance out of the child proof bottle 150 to remove a desired number of soft gelatin edible wafers 130. The child proof cap 160 is removed by pushing the cap towards the bottle and rotating to position the cap locking feature to clear the bottle locking feature when pulling the cap away from the bottle. FIG. 1 shows a plurality of soft gelatin edible wafers 130 placed in the tray for soft gelatin edibles 100 of one embodiment.

The soft gelatin edible wafers 130 product can include candies made with gelatin and some flavoring. In addition, medicinal ingredients can be infused into a soft gelatin edible wafer product recipe. Medicinal ingredients can include those used for treatment of pain and other diseases caused by oxidative stress. At least one treatment ingredient can include a prophylactic or therapeutically effective amount of a cannabinoid.

Cannabinoids including cannabidiol are a class of antioxidant drugs that have particular application as neuroprotectants. Cannabinoids can be useful in the treatment and prophylaxis of a wide variety of oxidation associated diseases, including ischemic, age-related, inflammatory and autoimmune diseases. A cannabinoid may be other than THC, HU-210, or other potent cannabinoid receptor agonists. The cannabinoid may also be other than HU-211 or any other NMDA receptor antagonist. The cannabinoid is not psychoactive, and is not psychotoxic even at high doses. A soft gelatin edible wafer product effective amount of a medicinal ingredient including a cannabinoid is easy for the user to administer and the tray for soft gelatin edibles 100 packaging makes it convenient for the user to carry of one embodiment.

DETAILED DESCRIPTION

Figure 2A:
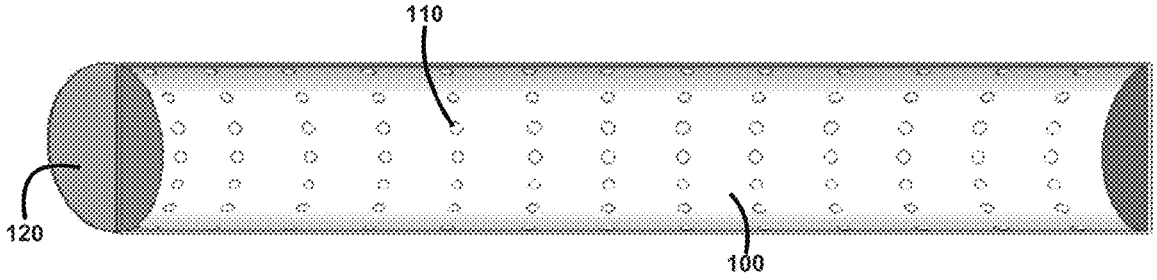
FIG. 2A shows an overview drawing of the tray for soft gelatin edibles top view of one embodiment.

FIG. 2A shows a block diagram of an overview flow chart of tray for soft gelatin edibles top view of one embodiment. FIG. 2A shows the tray for soft gelatin edibles 100 from a top view of the interior surface. The interior surface of the tray for soft gelatin edibles 100 includes an array of the anti-slide bump 110 features. Also showing is the pull tab 120 oriented to an angle away from the body of the tray for soft gelatin edibles 100 of one embodiment.

Figure 2B:
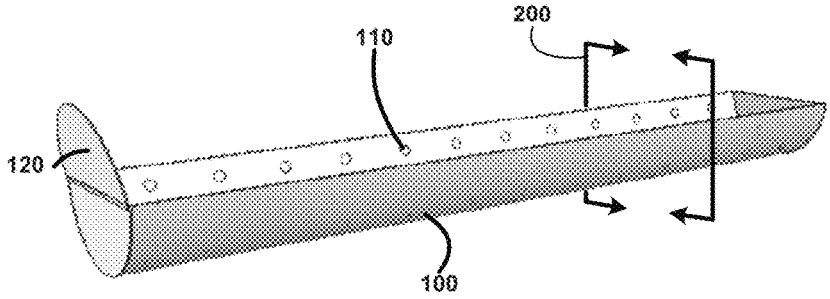
FIG. 2B shows an overview of the tray for soft gelatin edibles side prospective view of one embodiment.

Tray for Soft Gelatin Edibles Side Prospective View:

FIG. 2B shows a block diagram of an overview flow chart of tray for soft gelatin edibles side prospective view of one embodiment. FIG. 2B shows the tray for soft gelatin edibles 100 in a side prospective view. The anti-slide bump 110 features can be seen and the pull tab 120 oriented to an angle off of vertical. Section lines 200 are shown for a section view in FIG. 2C of one embodiment.

Figure 2C:
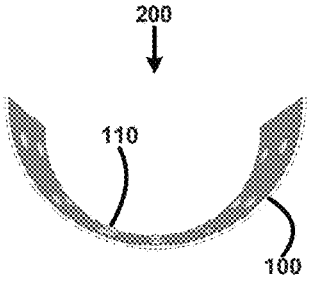
FIG. 2C shows for illustrative purposes only an example of the tray for soft gelatin edibles with anti-slide bumps of one embodiment.

Tray for Soft Gelatin Edibles Anti-Slide Bumps:

FIG. 2C shows for illustrative purposes only an example of tray for soft gelatin edibles anti-slide bumps of one embodiment. FIG. 2C shows a tray for soft gelatin edibles interior surface section view 200. The section view of the tray for soft gelatin edibles 100 interior surface anti-slide bump 110 features shows the raised aspect of the anti-slide bump 110. Rows of the anti-slide bump 110 features prevent the soft gelatin edible wafers 130 of FIG. 1 from sliding along the interior surface of the tray for soft gelatin edibles 100. Additionally the anti-slide bump 110 features reduce any sticking of the soft gelatin edible wafers 130 of FIG. 1 to the interior surface of the tray for soft gelatin edibles 100 of one embodiment.

Figure 3A:
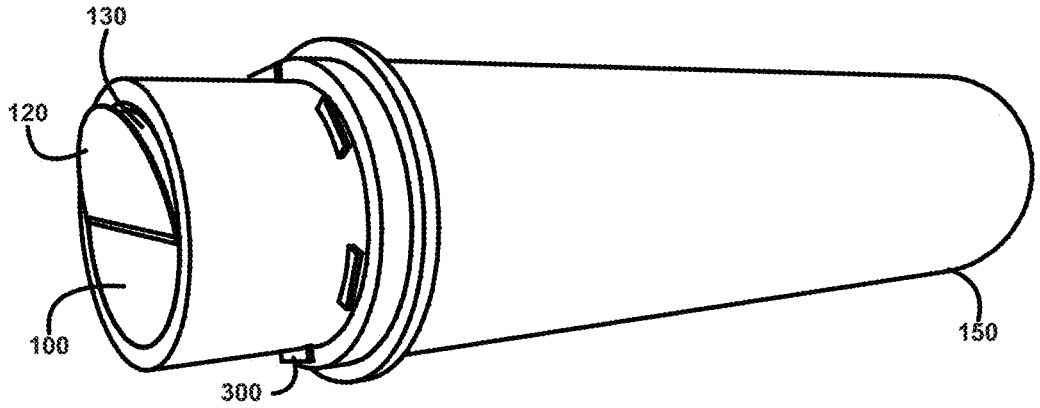
FIG. 3A shows for illustrative purposes only an example of the tray for soft gelatin edibles with a pull tab of one embodiment.

Tray for Soft Gelatin Edibles Pull Tab:

FIG. 3A shows for illustrative purposes only an example of a tray for soft gelatin edibles pull tab of one embodiment. FIG. 3A shows the tray for soft gelatin edibles 100 inserted into the child proof bottle 150. The pull tab 120 is shown in its angled off vertical orientation. Soft gelatin edible wafers 130 are seen behind the pull tab 120. A radial array of child proof bottle security tab 300 features of the child proof bottle 150 are shown and are used to secure the child proof cap 160 of FIG. 1 of one embodiment.

Figure 3B:
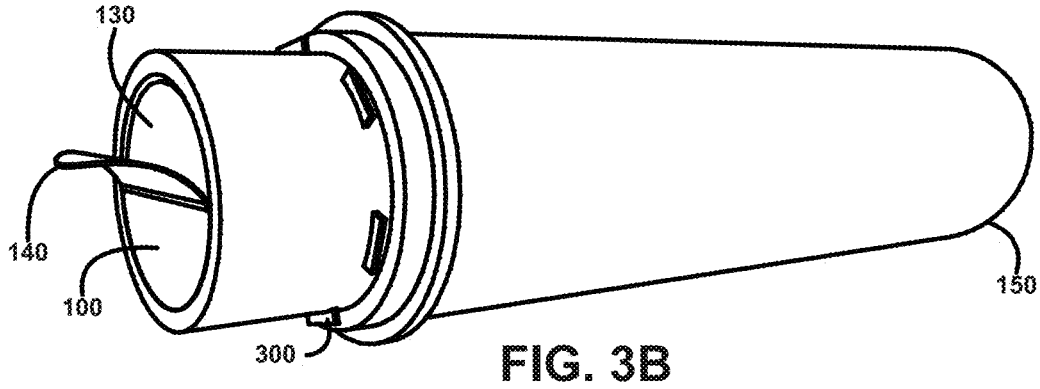
FIG. 3B shows for illustrative purposes only an example of the tray for soft gelatin edibles with a pull tab with flexibility of one embodiment.

Tray for Soft Gelatin Edibles Pull Tab Flexibility:

FIG. 3B shows for illustrative purposes only an example of a tray for soft gelatin edibles pull tab flexibility of one embodiment. FIG. 3B shows the tray for soft gelatin edibles 100, soft gelatin edible wafers 130, child proof bottle security tab 300 and child proof bottle 150. Also shown is the flexing pull tab 140 without showing a user finger or more digits bending the pull tab 120 of FIG. 1 from its angled off vertical orientation of one embodiment.

Figure 4A:
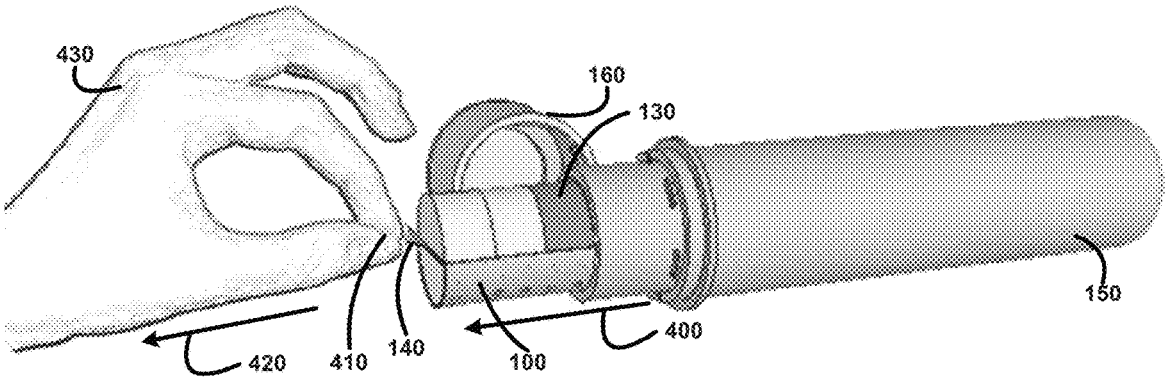
FIG. 4A shows for illustrative purposes only an example of a user pulling out the tray for soft gelatin edibles of one embodiment.

User Pulling Out Soft Gelatin Edible Tray:

FIG. 4A shows for illustrative purposes only an example of user pulling out the tray for soft gelatin edibles of one embodiment. FIG. 4A shows the tray for soft gelatin edibles 100 and an action of the tray for soft gelatin edibles being slid out 400 from the child proof bottle 150 with the child proof cap 160 removed. Soft gelatin edible wafers 130 are seen in the withdrawn the tray for soft gelatin edibles 100. A user hand 430 is shown using an index finger and thumb holding the flexing pull tab 140. A user hand pulling on the flexible pull tab 420 slides the tray for soft gelatin edibles 100 out a user desired distance from the child proof bottle 150 of one embodiment.

Figure 4B:
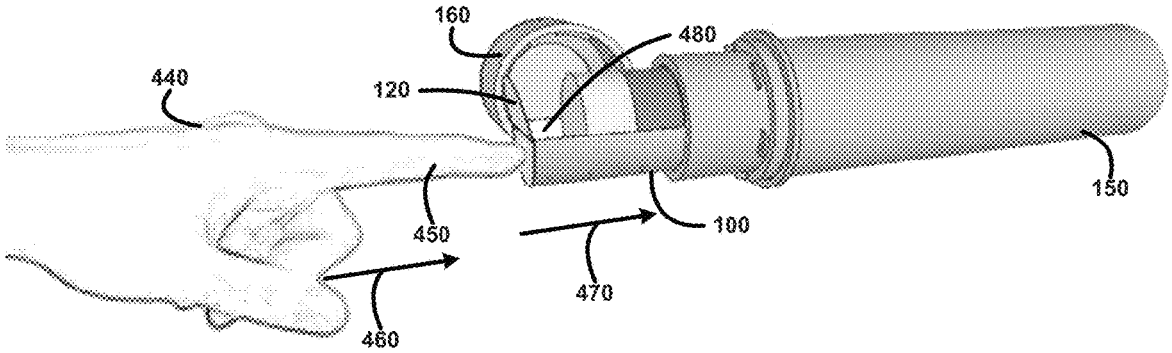
FIG. 4B shows for illustrative purposes only an example of a user pushing the tray for soft gelatin edibles into a bottle of one embodiment.

User Pushing Tray For Soft Gelatin Edibles Into Bottle:

FIG. 4B shows for illustrative purposes only an example of user pushing the tray for soft gelatin edibles into bottle of one embodiment. FIG. 4B shows a user hand pointing an index finger 440. A user index finger 450 is used by the user pushing the tray for soft gelatin edibles into the child proof bottle 460. The two front soft gelatin edible wafers taken out by user 480 can be seen as the tray for soft gelatin edibles is sliding into the child proof bottle 470. The tray for soft gelatin edibles 100 is shown being pushed back into the child proof bottle 150 with the child proof cap 160 removed. The pull tab 120 is shown having returned to its angle off of vertical orientation of one embodiment.

Figure 5A:
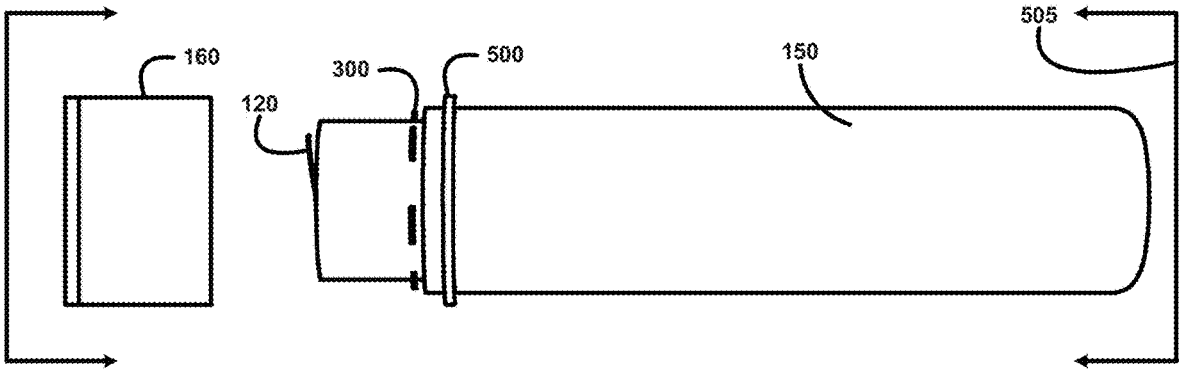
FIG. 5A shows for illustrative purposes only an example of the tray for soft gelatin edibles in a bottle and child proof cap with section lines of one embodiment.

Tray for Soft Gelatin Edibles in Bottle and Child Proof Cap Section Lines:

FIG. 5A shows for illustrative purposes only an example of the tray for soft gelatin edibles in bottle and child proof cap section lines of one embodiment. FIG. 5A shows the child proof bottle 150 with the child proof cap 160 pulled back from the child proof bottle 150. The pull tab 120 can be seen and the child proof bottle security tab 300. A stop ring 500 feature of the child proof bottle 150 is used to push against with the child proof cap 160 to provide clearance between the locking features of both the child proof bottle security tab 300 and corresponding cap security locking tab of one embodiment. Also shown are section cut lines 505 indicating a longitudinal section cut as seen in FIG. 5B.

Figure 5B:
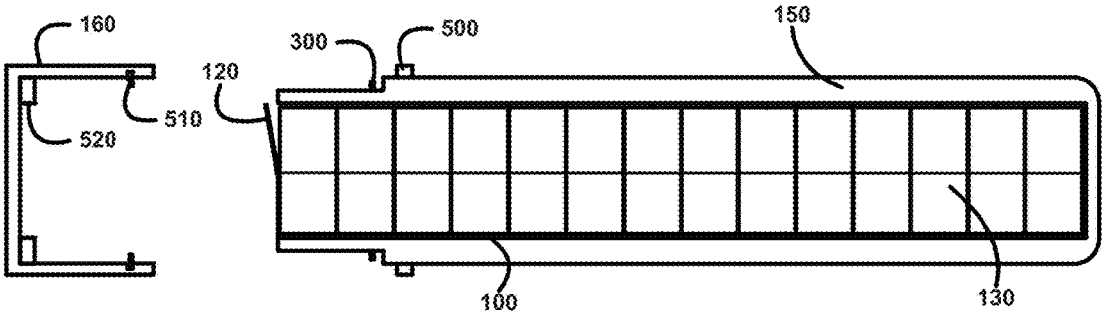
FIG. 5B shows for illustrative purposes only an example of the tray of soft gelatin edibles in a bottle with a section view of one embodiment.

Tray for Soft Gelatin Edibles in Bottle Section View:

FIG. 5B shows for illustrative purposes only an example of the tray for soft gelatin edibles in bottle section view of one embodiment. FIG. 5B shows a longitudinal section cut as shown by the section cut lines 505 of FIG. 5A. The child proof bottle 150 shows the child proof bottle security tab 300 features and stop ring 500 features. Also shown in the child proof bottle 150 are the tray for soft gelatin edibles 100, soft gelatin edible wafers 130 and pull tab 120. The child proof cap 160 section view shows a child proof cap security tab 510 used to couple with the child proof bottle security tab 300 to prevent a young child from opening the child proof bottle 150. Removing the child proof cap 160 performed by pushing the cap against the stop ring 500. Pushing the cap utilizes the child proof cap flexible push pad 520 which compresses as the cap is pushed to the stop ring 500. The child proof cap 160 is rotated to a position clearing the child proof cap security tab 510 from a locking position with the child proof bottle security tab 300. The child proof cap flexible push pad 520 decompresses when the security tabs are not in a locking position and the child proof cap 160 can be pulled away from the bottle locking feature when pulling the cap away from the child proof bottle 150 of one embodiment.

Figure 6A:
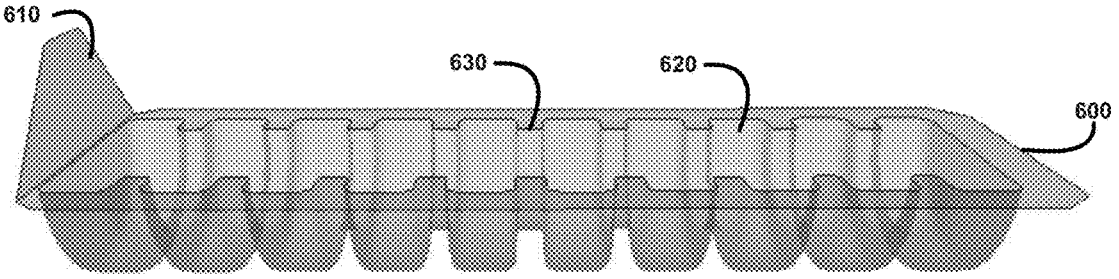
FIG. 6A shows for illustrative purposes only an example of the tray with soft gelatin edibles with slot receptacles of one embodiment.

Tray with Edible Slot Receptacles:

FIG. 6A shows for illustrative purposes only an example of a tray with edible slot receptacles of one embodiment. FIG. 6A shows a gelatin edible tray with gelatin edible wafer slot receptacles 600 made of a translucent NSF approved plastic. The gelatin edible tray with gelatin edible wafer slot receptacles 600 includes a flexible pull tab 610 at one end of the half-cylindrical gelatin edible tray that can flex upward when a child proof cap is coupled to a bottle. A plurality of gelatin edible wafer slot receptacles 620 prevent sliding of the gelatin edible wafers in the gelatin edible tray. A plurality of gelatin edible wafer slot receptacles dividers 630 separate the gelatin edible wafers and prevent the gelatin edible wafers from sticking together. A perimeter flexible edge bends as the gelatin edible tray with gelatin edible wafer slot receptacles 600 is inserted into a bottle and reduces slipping and rotating of the gelatin edible tray within the bottle of one embodiment.

Figure 6B:
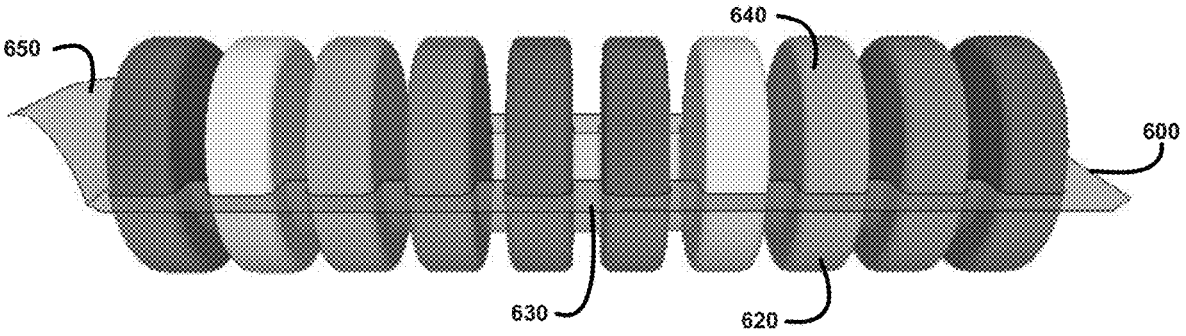
FIG. 6B shows for illustrative purposes only an example of the tray with soft gelatin edibles with slot receptacles of one embodiment.

Gelatin Edible Wafers Inserted into Gelatin Edible Slot Receptacles:

FIG. 6B shows for illustrative purposes only an example of gelatin edible wafers inserted into gelatin edible slot receptacles of one embodiment. FIG. 6B shows a gelatin edible wafer 640 inserted into each of the gelatin edible wafer slot receptacles 620 of the gelatin edible tray with gelatin edible wafer slot receptacles 600. Each gelatin edible wafer 640 is separated from the adjacent gelatin edible wafer 640 by the gelatin edible wafer slot receptacles dividers 630. The flexible pull tab bent down 650 is used to pull the gelatin edible tray with gelatin edible wafer slot receptacles 600 out of a bottle container of one embodiment.

The foregoing has described the principles, embodiments and modes of operation of the embodiments. However, the embodiments should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. An apparatus, comprising:

a half-cylindrical tray with anti-slide features on an interior surface and a flexible pull tab at one end of the half-cylindrical tray;

wherein the anti-slide features include an array of raised anti-slide bumps configured to reduce soft gelatin edible wafers from sliding along the interior surface of the tray and reduce any sticking of the soft gelatin edible wafers to the interior surface of the tray;

wherein the anti-slide features include a plurality of wafer slot receptacles configured to prevent sliding of the soft gelatin edible wafers in the tray;

wherein the anti-slide features include a plurality of gelatin edible wafer slot receptacles dividers to separate the gelatin edible wafers and prevent the gelatin edible wafers from sticking together;

wherein the half-cylindrical tray is sized and shaped to accommodate sizes and shapes of soft gelatin edible wafer products including gelatin edible candies and gelatin wafer products with infused medicinal ingredients;

the flexible pull tab at one end of the half-cylindrical tray includes a half round disc wherein the half round disc is inverted to orient the half round shape;

a child proof bottle with child proof bottle security tabs wherein the tray is inserted;

a child proof cap with child proof cap security tabs corresponding to the child proof bottle security tabs for securing the child proof cap to the child proof bottle;

wherein the child proof cap is configured to include a flexible push pad configured to compress as the cap is pushed to a bottle stop ring and rotated to a position clearing child proof cap security tabs from a locking position; and wherein the flexible push pad is configured to decompress when the security tabs are not in a locking position and the child proof cap is pulled away from the bottle locking feature when pulling the cap away from the child proof bottle.

2. The apparatus of claim 1, further comprising the anti-slide features on an interior surface include anti-slide rings configured for preventing gelatin edible wafer products from sliding out unintentionally from the tray.

3. The apparatus of claim 1, wherein the flexible pull tab at one end of the half-cylindrical tray includes the half round disc wherein the half round disc is inverted to orient the half round shape of the flexible pull tab opposite to the half cylindrical round shape of the tray.

4. The apparatus of claim 1, wherein the flexible pull tab includes configuring the flexible pull tab for orienting to an angle off of vertical and angled away from the tray body.

5. The apparatus of claim 1, wherein the child proof bottle is configured for including a stop ring used for pushing the child proof cap against in an action to remove the child proof cap and wherein the child proof cap is configured to include the flexible push pad configured to compress as the cap is pushed to the stop ring and rotated to a position clearing child proof cap security tabs from a locking position and the flexible push pad is configured to decompress when the security tabs are not in a locking position and the child proof cap is pulled away from the bottle locking feature when pulling the cap away from the child proof bottle.

6. The apparatus of claim 1, wherein the half-cylindrical tray is sized and shaped for storing gelatin edible wafer products sized and shaped for an effective amount of infused medicinal ingredients including medicinal ingredients used for treatment of pain and other diseases caused by oxidative stress including at least one treatment ingredient including a prophylactic or therapeutically effective amount of a cannabinoid wherein the half-cylindrical tray provides packaging to make it convenient for the user to carry.

7. The apparatus of claim 1, wherein the half-cylindrical tray is sized and shaped for storing gelatin edible wafer products with sizes and shapes to provide an effective amount of infused medicinal ingredients including cannabinoids including cannabidiol antioxidant drugs with application as neuroprotectants wherein using the infused cannabinoids for a treatment and prophylaxis of a wide variety of oxidation associated diseases, including ischemic, age-related, inflammatory and autoimmune diseases and wherein the cannabinoids do not include THC, HU-210, HU-211 or any other NMDA receptor antagonist and wherein the cannabinoid is not psychoactive, and is not psychotoxic even at high doses.

8. An apparatus, comprising:

a storage device for storing gelatin edible wafer products including gelatin edible wafer candies and gelatin edible wafer products with infused medicinal ingredients;

wherein the storage device is configured to include a half-cylindrical tray with anti-slide features on an interior surface and a flexible pull tab at one end of the half-cylindrical the tray;

wherein the half-cylindrical tray storing gelatin edible wafer products sized and shaped to deliver an effective amount of infused medicinal ingredients;

wherein the storage device is configured to include a child proof bottle with child proof bottle security tabs wherein the tray is inserted; and wherein the storage device is configured to include a child proof cap with child proof cap security tabs corresponding to the child proof bottle security tabs for securing the child proof cap to the child proof bottle;

wherein the child proof cap is configured to include a flexible push pad configured to compress as the cap is pushed to a stop ring and rotated to a position clearing child proof cap security tabs from a locking position; and wherein the flexible push pad is configured to decompress when the security tabs are not in a locking position and the child proof cap is pulled away from the bottle locking feature when pulling the cap away from the child proof bottle.

9. The apparatus of claim 8, wherein the half-cylindrical tray be made of a translucent NSF approved plastic.

10. The apparatus of claim 8, wherein the flexible pull tab at one end of the half-cylindrical tray is configured to include a half round disc wherein the half round disc is inverted to orient the half round shape of the flexible pull tab opposite to the half cylindrical round shape of the tray.

11. The apparatus of claim 8, wherein the child proof bottle is configured to include a stop ring wherein the child proof cap is pushed against the stop ring before rotating to remove the child proof cap.

12. The apparatus of claim 8, wherein the storage device with the half-cylindrical tray storing gelatin edible wafer products with infused medicinal ingredients including an effective amount of medicinal ingredients used for treatment of pain and other diseases caused by oxidative stress including at least one treatment ingredient including a prophylactic or therapeutically effective amount of a cannabinoid.

13. The apparatus of claim 8, wherein the storage device with the half-cylindrical tray storing gelatin edible wafer products with infused medicinal ingredients including cannabinoids including an effective amount of cannabidiol antioxidant drugs with application as neuroprotectants wherein using the infused cannabinoids for a treatment and prophylaxis of a wide variety of oxidation associated diseases, including ischemic, age-related, inflammatory and autoimmune diseases and wherein the cannabinoids do not include THC, HU-210, HU-211 or any other NMDA receptor antagonist and wherein the cannabinoid is not psychoactive, and is not psychotoxic even at high doses.

* * * * *